US009314799B2

(12) United States Patent
Lumsden

(10) Patent No.: US 9,314,799 B2
(45) Date of Patent: Apr. 19, 2016

(54) APPARATUS FOR CONTINUAL MAGNETISATION OF A SLURRY

(75) Inventor: Barry Lumsden, Warrawee (AU)

(73) Assignee: AUSMETEC PTY LTD., Cromer (AU)

( * ) Notice: Subject to any disclaimer, the term of this patent is extended or adjusted under 35 U.S.C. 154(b) by 539 days.

(21) Appl. No.: 13/695,056

(22) PCT Filed: Apr. 29, 2011

(86) PCT No.: PCT/AU2011/000493

§ 371 (c)(1),
(2), (4) Date: Oct. 29, 2012

(87) PCT Pub. No.: WO2011/134017

PCT Pub. Date: Nov. 3, 2011

(65) Prior Publication Data

US 2013/0037490 A1 Feb. 14, 2013

(30) Foreign Application Priority Data

Apr. 29, 2010 (AU) ..... 2010901799

(51) Int. Cl.

| | |
|---|---|
| ***B03C 1/28*** | (2006.01) |
| ***B03D 1/02*** | (2006.01) |
| *B03D 1/14* | (2006.01) |

(52) U.S. Cl.

CPC ..... *B03C 1/286* (2013.01); *B03C 1/284* (2013.01); *B03D 1/025* (2013.01); *B03C 2201/18* (2013.01); *B03D 1/1493* (2013.01); *B03D 2203/02* (2013.01)

(58) Field of Classification Search

CPC .... B03C 1/284; B03C 1/286; B03C 2201/18; B03D 1/025; B03D 2203/02

See application file for complete search history.

(56) References Cited

U.S. PATENT DOCUMENTS 7,429,331 B2 9/2008 Lumsden

FOREIGN PATENT DOCUMENTS

| | | | |
|---|---|---|---|
| CN | 1642653 | A | 7/2005 |
| JP | 2008253959 | A | 10/2008 |
| RU | 2106896 | C1 | 3/1998 |
| RU | 2184618 | C1 | 7/2002 |
| RU | 2288781 | C2 | 12/2006 |
| RU | 141140 | U1 | 5/2014 |
| WO | WO2009/124342 | | 10/2009 |
| WO | WO 2011134017 | A1 * | 11/2011 |

OTHER PUBLICATIONS

The Internatioanl Preliminary Report on Patentability for PCT/AU2011/000493, dated Aug. 7, 2012.*

* cited by examiner

*Primary Examiner* — David A Reifsnyder
(74) *Attorney, Agent, or Firm* — Mark M. Friedman

(57) ABSTRACT

An apparatus for inducing magnetism in a flowstream of an at least partially magnetisable particulate feed material suspended in a liquid, in use to condition the flowstream to enhance the subsequent separation process, the apparatus including: a treatment chamber having an inlet and an outlet through which the flowstream respectively enters and exits the chamber; and a magnetic source within the treatment chamber, said magnetic source substantially continuously immersed in and activated with respect to the flowstream.

19 Claims, 4 Drawing Sheets

APPARATUS FOR CONTINUAL MAGNETISATION OF A SLURRY

FIELD OF THE INVENTION

The present invention relates to the field of mineral processing and, more particularly, to methods and apparatus for enhancing the efficiency of magnetising a slurry for the extraction of minerals from a flowstream.

BACKGROUND ART

1. Mineral Separation

Many important metal ores are sulfides. Significant examples include; argentite (silver sulfide), galena (lead sulfide), molybdenite (molybdenum sulfide), pentlandite (nickel sulfide]), realgar (arsenic sulfide), and stibnite (antimony), sphalerite (zinc sulfide), and pyrite (iron disulfide), and chalcopyrite and bornite (iron-copper sulfide). Vaughan, D. J. Craig, J. R. 1978

Mined base metal sulfide ore generally contains around 0.5% to 15% of valuable metal, with the remainder being waste. Separating the valuable metal from the waste is usually carried out by grinding an ore-water mix in a mill with steel balls or rods. The grind slice varies but the particles are generally in the size range of 1-120 microns. The metal sulfides are separated by adding chemicals and floating the valuable metal sulfides to the surface in a froth phase and the waste remains in the slurry and reports to the tailings. This flotation separation process is limited in its efficiency.

2. Selective Recovery of Fine Minerals

In the separation of valuable minerals from an ore, whether by flotation separation or gravity separation or some other method, it has been found that fine minerals, those less than 38 μm and more preferably less than 20 μm are difficult to recover efficiently.

An invention that substantially improves the magnetization of the slurry so that there is an increase in the recovery of these <20 μm minerals or that would magnetise the slurry more efficiently or at a lower cost would be very advantageous.

Another problem that can arise in the removal of the magnetic material from the magnetic source is that removing the magnetic source from the flow-stream and washing the accumulated magnetic material from the magnetic housing is not sufficient to remove all the accumulated material. This is because the accumulated material can be iron based material that in the oxidising aqueous environment of the flowstream slowly oxidizes (rusts) and can form a crust on the magnetic source housing. This oxidized iron crust needs to be disturbed or wiped in order for it to be removed to the slurry flowstream. For this reason a combined wiping and flowstream washing is required to remove all the accumulated magnetic material from the magnetic source.

It is postulated that any build-up of accumulated magnetised material on the magnetic source increases the distance between the magnetic source and the flowstream thus reducing the magnitude of the magnetic induction to the flowstream.

The requirement to mechanically move the magnetic source in and out of the flowstream requires that in the design of the piston magnetic source tolerances are required between the piston and housing. These tolerances increase the distance between the magnetic source and the slurry and so reduce the magnetic induction in the slurry.

It is postulated that in the magnetization of flotation slurry to selectively aggregate the paramagnetic minerals there may be an advantage if the magnetic source could remain in a fixed position in the magnetic source housing in the slurry flowstream. The advantages may be:

1. If the magnet remains in the flowstream, then the slurry is being continuously magnetised.
2. If the magnets remain stationary there is no limit to the mass of the magnets and allows for stronger magnetic fields since they are fixed and not being moved and so reduces the mechanical complexity of deactivating the magnetic source
3. If the magnets remain stationary and the mechanical complexity of deactivating the magnets is reduced then different materials can be used in the fabrication of the magnetic housing allowing closer proximity between the magnet and the flowstream, allowing for stronger magnetic induction in the slurry
4. It allows much closer proximity between the magnet and the flowstream and results in higher average magnetic inductions in the flowstream because no tolerance is required for the mechanical movement of the magnet
5. Because a heavy magnet is not being moved in and out of the flowstream then lower energy consumption is required and also lower maintenance.
6. The magnetic source can be cleaned more rapidly because only a wiper or series of wipers and not the massive magnet is moved, thereby, maintaining a stronger magnetic induction over a longer period of time
7. The speed of wiper movement to dislodge the ferromagnetic build-up can be varied depending on the amount of strongly magnetic material in the slurry, typically from 4 meters/minute to 0.5 meters/minute.
8. The combination of wipers and moving flowstream is more effective in removing the ferromagnetic build-up because of the physical wiping, instead of relying on washing alone while the magnet is deactivated
9. Because the magnet is maintained in the slurry and not removed from the slurry there is no exposure to personnel, equipment or tools from the magnetic induction, which is a safety consideration.

Notes

The term "comprising" (and grammatical variations thereof) is used in this specification in the inclusive sense of "having" or "including", and not in the exclusive sense of "consisting only of".

The references listed at the end of the detailed description section and their disclosure are incorporated herein by cross-reference. However the above discussion of the prior art in the Background of the invention or elsewhere in this specification, is not an admission that any information discussed therein is citable prior art or part of the common general knowledge of persons skilled in the art in any country.

BRIEF DESCRIPTION OF INVENTION

Definitions

Fine Mineral: In this specification "fine mineral" means ore particles after grinding or other processing step in the size range predominantly between zero and substantially 38 μm and more preferably between zero and substantially 25 μm.

In a preferred form, there is described a process for magnetizing at least a portion of a feed material in a flowstream, the portion including material fractions having a range of magnetic susceptibilities, the process including the steps of passing the feed through a treatment chamber containing a magnetic source which remains continuously in the flowstream so as to induce magnetism in the portion thereby to enhance the subsequent separation of a more weakly magnetic feed material fraction from a more strongly magnetic feed material fraction and a least magnetic feed material fraction.

A particular form of magnetic field enhancement is implemented as a wiper mechanism or series of wiper mechanisms operating over the external surface of the magnetic source.

In a particular form the magnetic source is a high gradient field source.

In a particular form there is disclosed a process which aggregates paramagnetic particles in a flowstream in order to reduce their tendency to be entrained in a flotation froth. This is important when you want to keep them in the flowstream. One magnetises the paramagnetic minerals to reduce entrainment in the froth. Because aggregated or coarser particles are less likely to be entrained they remain in the slurry flowstream (Trahar 1981). This allows these paramagnetic aggregates that have not been entrained in an early stage to be available at a subsequent stage to be actively floated in a desired concentrate.

Accordingly, in one broad form of the invention there is provided an apparatus for inducing magnetism in a flowstream of an at least partially magnetisable particulate feed material suspended in a liquid, in use to condition the flowstream to enhance the subsequent separation process, the apparatus including:

a treatment chamber having an inlet and an outlet through which the flowstream respectively enters and exits the chamber; and a magnetic source within the treatment chamber, said magnetic source substantially continuously immersed in and activated with respect to the flowstream.

Preferably, the magnetic source has magnetic material mechanically removed from it without the magnetic source exiting the flowstream or being deactivated during the step of mechanical cleaning thereby continuously magnetizing the flowstream.

Preferably, the magnetic source located in the flowstream has magnetised material removed from the magnetic source by a wiper or series of wipers moving over a face of the magnetic source in combination with the action of the moving flowstream thereby to wash the magnetic material cleaned from the magnetic source back into the flow stream and through the chamber.

Preferably, the magnetised material removed from magnetic source remains in the flowstream and is not removed from the flowstream.

Preferably, the wiper is made of metal, plastic or rubber or stainless steel, or another metallic or non-metallic material.

Preferably, the magnetic material is removed by wiping into the flowstream the magnetic material attached to the magnetic source without removing the magnetic source from the flowstream or de-activating the magnetic source, or removing the magnetic material from the flowstream.

Preferably, the wiper is moved along the surface of the magnetic source so as to wipe the attached magnetic material into the flowstream.

Preferably, the wiper is moved by a pneumatic piston.

Preferably, the wiper is moved by an electric motor.

Preferably, the wiper is moved in a longitudinal direction along the surface of the magnetic source.

Preferably, the wiper is moved in a latitudinal direction along the surface of the magnetic source.

Preferably, the wiper disturbs the magnetic material so that the flow of the flowstream washes the magnetic material into the flowstream.

Preferably, a series of wipers is used to wipe the magnetic source.

Preferably, the magnetic source has a magnetic induction at the flowstream/magnetic source interface of greater than 3000 gauss.

Preferably, the magnetic source has a magnetic induction at the flowstream/magnetic source interface of greater than 3000 gauss over the whole face of the magnetic source.

Preferably, the feed material includes paramagnetic and ferromagnetic particulates.

Preferably, the feed material includes paramagnetic and diamagnetic particulates.

Preferably, the paramagnetic particulates include at least one sulfide mineral containing copper, zinc, nickel, lead, or another transition metal or a precious metal such as gold, silver or platinum group metals.

Preferably, the paramagnetic particulates include at least one of the group including sphalerite contaminated with iron, arsenopyrite, cassiterite, chalcopyrite, bornite, galena, pentlandite, platinum metal gold, silver and palladium metal.

In a further broad form of the invention, there is provided an apparatus for magnetizing a portion of a feed material, the apparatus including:

a treatment chamber having an inlet and an outlet through which the flowstream respectively enters and exits the chamber; and a magnetic source within the treatment chamber wherein the magnetic source has magnetic material cleaned/removed from it without the material exiting the flowstream or the magnetic source being de-activated thereby to continuously magnetize the flowstream.

Preferably, the magnetic source is located in the flowstream and has magnetic material removed from it by a wiper moving over the face of the magnetic source.

Preferably, the magnetic source is arranged such that when it removes the magnetiseable material the material remains in the flowstream and is not removed.

Preferably, the flowstream moves substantially perpendicular to the movement of the wiper of the magnetic source.

Preferably, the magnetic source induces magnetism in at least a portion of the particulate feed material in the chamber; the portion including material fractions having a range of magnetic susceptibilities, the apparatus including a treatment chamber and a magnetic source permanently activated with respect to the treatment chamber to induce magnetism in the portion so as to facilitate the subsequent separation of a more weakly magnetic feed material fraction from a more strongly magnetic feed material fraction and a least magnetic feed material fraction.

Preferably, the more weakly magnetic feed material fraction includes mainly paramagnetic particulates and the more strongly magnetic feed material fraction includes mainly ferromagnetic particulates and the least magnetic material fraction includes mainly diamagnetic particulates.

In yet a further broad form of the invention, there is provided an apparatus for inducing magnetism in a flowstream of an at least partially magnetisable particulate feed material suspended in a liquid, the apparatus including:

a treatment chamber having an inlet and an outlet through which the flowstream respectively enters and exits the chamber; and a magnetic source within the treatment chamber, wherein the magnetic source remains in the treatment chamber and is permanently activated.

Preferably, the magnetic source has magnetic material cleaned/removed from it without exiting the flowstream or being de-activated thereby to continuously magnetize the flowstream.

Preferably, the magnetic source is located in the flowstream and has magnetised material removed from it by a wiper moving over the face of the magnetic source.

Preferably, the magnetic source removes the magnetiseable material whilst remaining in the flowstream and is not removed from the flowstream.

Preferably, when activated in use, the magnetic source induces magnetism in at least a portion of the particulate feed material in the chamber whilst maintaining that portion in the flowstream in the treatment chamber.

Preferably, the portion includes material fractions having a range of magnetic susceptibilities, the process including the steps of passing the feed through a treatment chamber containing a magnetic source to induce magnetism in the portion so as to enhance the subsequent separation of a more weakly magnetic feed material fraction from a more strongly magnetic feed material fraction and a least magnetic feed material fraction.

Preferably, the process also includes the step of subsequently separating the weakly magnetised feed material fraction from the more strongly magnetised feed material fraction and a least magnetic feed material fraction by a flotation separation process.

Preferably, the flotation separation process recovers the weakly magnetised feed material in a froth phase.

Preferably, the more weakly magnetic feed material fraction includes mainly paramagnetic particulates and the more strongly magnetic feed material fraction includes mainly ferromagnetic particulates and the least magnetic feed material fraction includes mainly diamagnetic particulates.

Preferably, at least some of the magnetisable feed material is paramagnetic, the induced magnetism causing at least some of the magnetised paramagnetic particles to become aggregated in the liquid flowstream.

Preferably, at least some of the magnetisable feed material is paramagnetic, the induced magnetism causing at least some of the magnetised paramagnetic particles to become aggregated in the liquid flowstream so as to reduce its recovery by entrainment in a froth phase.

Preferably, at least some of the magnetisable feed material is paramagnetic, the induced magnetism causing at least some of the magnetised paramagnetic particles to become aggregated in the liquid flowstream so as to reduce its recovery by entrainment in a froth phase thereby maintaining the aggregated mineral in the slurry phase and allowing a subsequent recovery in a subsequent froth phase.

Preferably, field enhancement is implemented as a wiper mechanism or series of wiper mechanisms operating over the external surface of the magnetic source.

In yet a further broad form of the invention, there is provided a method of increasing the efficiency of separation of a desired material having weakly magnetic properties and being contained in a flowstream; said material including paramagnetic particles of less than substantially 38 micron size; said method comprising aggregating said paramagnetic particles of less than 38 micron size to greater size in order to reduce their tendency to be entrained in flotation froth.

Preferably, once aggregated if it is a desired aggregated particle it will float as part of a floatation separation process or if it is not a desired aggregated particle it can be expected to be rejected from being entrained in the flotation concentrate and be available for harvesting in a separate stage which targets the aggregated particle as a desired aggregated particle.

BRIEF DESCRIPTIONS OF DRAWINGS

Embodiments of the present invention will now be described with reference to the accompanying drawings wherein.

DETAILED DESCRIPTIONS OF PREFERRED EMBODIMENTS

Figure 1A:
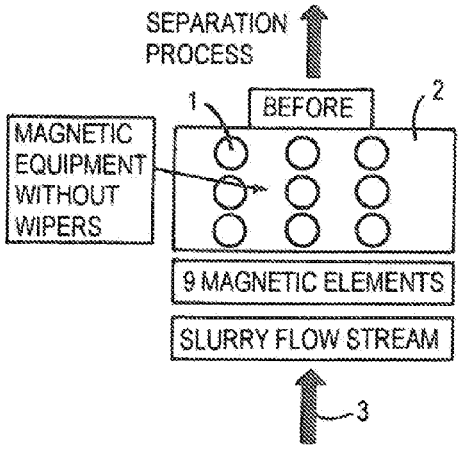
FIGS. 1A and 1B illustrate the effect of equipment sizing on using wiper magnetising according to a first-preferred embodiment of the present invention.

It has been discovered that magnetizing a flotation slurry that contains a number of paramagnetic minerals can result in not only the increase in recovery of some paramagnetic minerals that are actively collected but also the reduction in recovery of other paramagnetic minerals that are recovered by entrainment. This is a surprising result. It was thought that there would be heteroaggregation of all the paramagnetic minerals, but what has been discovered is that there is primarily homoaggregation of the paramagnetic minerals. However, in flotation some fine mineral is recovered not by being actively floated but by being entrained in the froth. This is a well recognized phenomenon. Entrainment is most pronounced for fine minerals and generally increases with the fineness of the minerals. Therefore, if the mineral can be aggregated then its particle size will increase and there will be less entrainment of these mineral in the froth, if the plant is not actively trying to float them.

For example, in a recent investigation in a plant the slurry contained the paramagnetic sulfides chalcopyrite and sphalerite. The process operates to produce a chalcopyrite concentrate first and then subsequently a sphalerite concentrate. When magnetic conditioning was applied to the chalcopyrite slurry the chalcopyrite recovery increased (less copper in the tailings from the process) but the recovery of the sphalerite in the chalcopyrite concentrate actually declined.

| | % Cu Rec | % Cu in Tailings | % Zn Recovery in Cu Concentrate | % Zn Recovery in Zn Concentrate |
|---|---|---|---|---|
| Magnetic Conditioning ON | 84.5 | 0.5 | 7.41 | 79.7 |
| Magnetic Conditioning OFF | 84.0 | 0.54 | 7.96 | 77.9 |

This data is showing that the copper recovery (Chalcopyrite) a paramagnetic mineral increases because of magnetic conditioning due to the aggregation of the chalcopyrite. But the zinc recovery (sphalerite) decreases in the copper concentrate, and increases in the zinc concentrate. This confirms that the decrease recovery in the copper concentrate and the increase in recovery in the zinc concentrate is due to magnetic aggregation of the paramagnetic sphalerite. This is a surprising result since there appears to be no heteroaggregation and it gives a far superior separation, because of less entrainment of the paramagnetic sphalerite in the copper concentrate.

In another example also a copper-zinc separation this effect was seen again. When magnetic conditioning was applied to the copper flotation stage there was a reduction in the zinc concentration in the copper concentrate meaning less zinc was being recovered to the copper concentrate. This gave a more valuable copper concentrate because zinc attracts a penalty cost in copper concentrate and zinc recovered to copper is not recovered to the zinc where it is paid for.

| | % Cu Rec to Cu Conc | % Zn Cu Conc | % Zn Rec Cu Conc | % Zn Rec Zn Conc |
|---|---|---|---|---|
| Magnetic Conditioning ON | 73.36 | 9.15 | 15.06 | 74.04 |
| Magnetic Conditioning OFF | 70.67 | 9.90 | 15.38 | 73.76 |
| Difference | 2.69 | 0.75 | 0.32 | 0.28 |

This effect is not necessarily restricted to copper-zinc separations, but would also apply to other separations where a paramagnetic mineral is being separated at a second stage. So, for instance, in some flotation plants there is a pre-float stage to remove certain minerals that are then discarded. One such example is the removal of talc from an ore. High levels of talc are deleterious to chalcopyrite flotation so frequently talc is removed prior to chalcopyrite flotation. There is a pre-float where talc is removed by flotation and subsequently chalcopyrite is separated from the ore by flotation. Fine <38 micron copper is lost in the talc concentrate as it is entrained in the froth. This is detrimental to plant performance because this copper is lost and not paid for. Magnetic conditioning would increase the chalcopyrite particle size reducing the loss of copper to the talc concentrate by entrainment, and therefore increasing the copper recovery to the subsequent copper separation stage.

In a further aspect with reference to the discussion in the background art, there will now be described apparatus and a methodology to maximize the magnetic induction in the slurry flowstream by maximizing the magnetic induction strength of the magnetic source and by minimizing the distance between the magnetic source and the slurry flowstream. with a ferromagnetic cleaning mechanism that maintains the magnetic source in a stationary position within the flowstream to maximize slurry residence time in the magnetic field.

The importance of the higher field strength due to wiper cleaning and the greater residence time in the magnetic field due to continuous activation of the magnetic source in the slurry flowstream allows for greater magnetization and aggregation of the mineral particles and reduced equipment requirements, therefore improving the overall process. This is represented diagrammatically in FIG. 1. FIG. 1 illustrates the effect of equipment sizing on using wiper magnetising. In the cleaning process the magnet may be de-activated for 25%-35% of the time to clean the magnet. With this invention because deactivation of the magnetic source does not occur, the number of magnetic sources can be reduced by 25%-35%.

In this instance the arrangement of FIG. 1A shows an arrangement of magnetic sources 1 in an array within a predetermined treatment volume 2. In this instance there are nine sources intended to achieve a predetermined level of magnetic irradiation of a flowstream 3 passing there through.

Figure 1B:
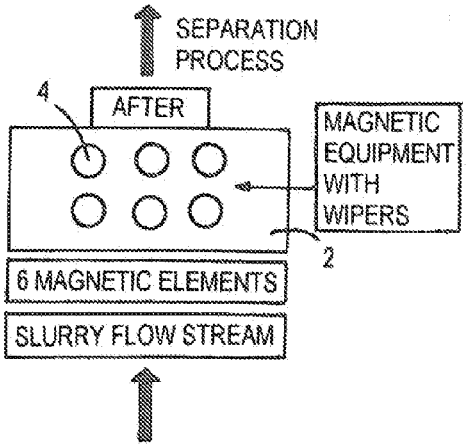

FIG. 1B illustrates the same predetermined treatment volume 2 this time with magnetic sources 4 having associated therewith wipers (refer later description) which mechanically clean the exterior of the sources 4 whilst the sources 4 are retained within the flowstream 3 on a continuous basis. As has been described above and with reference to the later described embodiments a smaller number of sources 4 can achieve the same level of magnetic irradiation for the same predetermined treatment volume 2.

In a further aspect, again with reference to the discussion in the background art, there will now be described alternative apparatus and methods for cleaning the magnetic source housing that does not require the deactivation of the magnetic source by movement of the magnetic source in and out of the slurry and so allows the magnetization of the slurry flowstream to be maximized.

A Wiping Mechanism to Wipe Off the Build-Up of the Ferromagnetic Minerals.

This method of cleaning has these advantages:

- Higher magnetic inductions achievable because the magnet is closer to the slurry. A stainless steel housing can be as thin as 1 mm with a 1 mm wear lining, whereas, for a moving magnet, there is the tolerance for the movement, a thicker stainless steel housing is required because of the mass moved, wear resistant guides are required and the thickness of a wear lining this all adds up to around 10 mm.
- Larger, heavier and therefore stronger magnetic sources can be used increasing the magnetic induction of the slurry
- Less energy is required for wiping than lifting a heavy magnet
- Lower cost of production
- Cleaning the magnetic source is faster since no magnet movement is require so the magnet spends no time out of the slurry and the slurry is better magnetised
- Safer operation less potential exposure to magnetic field
- Lower maintenance costs
- More flexibility in magnet designs because the magnet is not moving or attached to a piston.

Figure 2:
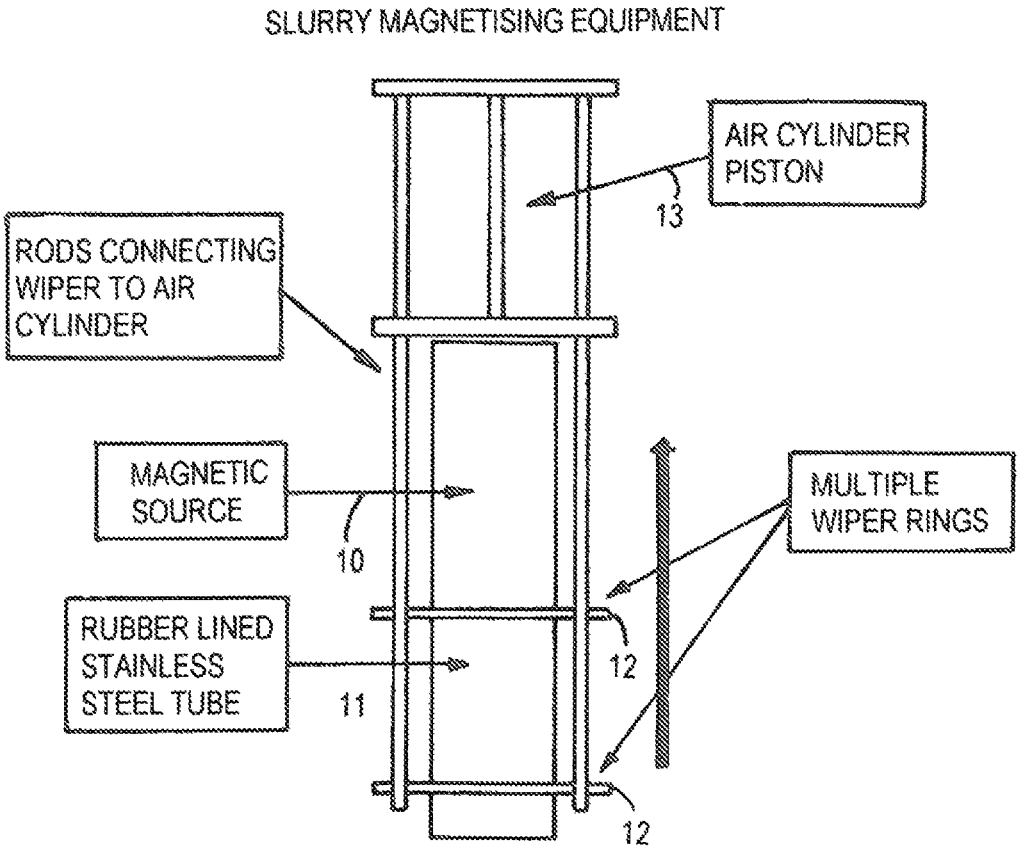
FIG. 2 illustrates the slurry magnetising equipment according to a preferred embodiment of the invention.
Figure 3:
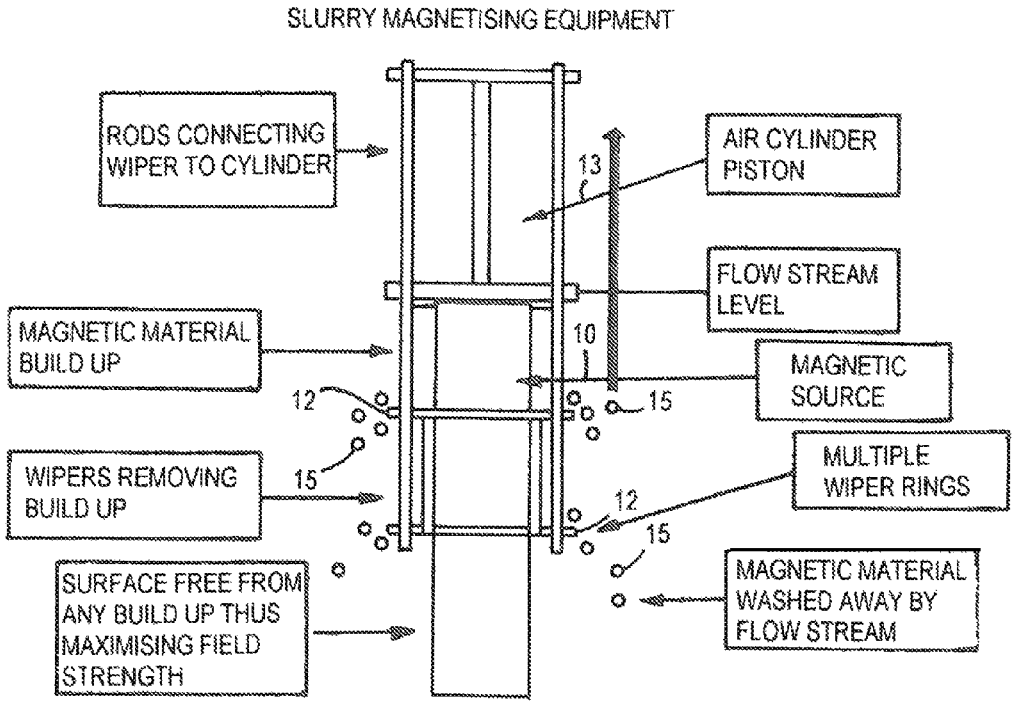
FIG. 3 shows the effect of the combined wiping and flowstream movement in wiping the magnetic housing clean and removing the build-up of ferromagnetic material into the flowstream.

This preferred method with reference to FIGS. 1, 2, 3 works by the magnetic source 10 being housed in a stainless steel housing 11 with a very thin abrasion resistant rubber lining and a rubber lined stainless steel scraper 12 on a piston 13 moving vertically up and down the external face 11 of the magnetic housing 11. The magnetic source 10 in the housing 11 with the scraper 12 attached is located in the slurry flowstream 14. As the scraper 12 moves over the face of the magnetic housing 11 it disturbs and dislodges the ferromagnetic material 15 that has built, while still attracted to the magnet. The force of the moving flowstream 14 is sufficient to force the magnetic material 15 back into the flowstream 14 and away from the magnetic source 10, thus cleaning the build-up of magnetic material 15 on the magnetic housing 11.

A wiping mechanism combined with the flowstream washing to wipe off the build-up of the ferromagnetic minerals.

This method of cleaning has these advantages:

- Higher magnetic inductions achievable because the magnet is closer to the slurry. A stainless steel housing can be as thin as 1 mm with a 1 mm wear lining, whereas, for a moving magnet, there is the tolerance for the movement, a thicker stainless steal housing is required and the thickness of a wear lining this all adds up to around 10 mm.

Less energy is required for wiping than lifting a heavy magnet

Lower cost of production and maintenance

Single or multiple wipers mean cleaning the magnetic source is faster since no magnet movement is require so the magnet spends no time out of the slurry and the slurry is better magnetised Safer operation less potential exposure to magnetic field More flexibility in magnet designs because the magnet is not moving or attached to a piston.

FIG. 3 illustrates the slurry magnetising equipment according to a preferred embodiment of the invention. Like components are numbered as for the embodiment described above with reference to FIG. 2.

FIG. 3 shows the effect of the combined wiping and flowstream movement in wiping the magnetic housing clean and removing the build-up of magnetised material including ferromagnetic material into the flowstream.

This method (refer FIG. 3) works by the magnetic source 10 being housed in a thin stainless steel housing 11 (1 mm) with a very thin rubber lining (1 mm) and one or more rubber lined stainless steel wipers or scrapers 12 mounted on a piston 13 which moves vertically up and down the external face 11 of the magnetic housing 11. The magnetic source 10 in the housing 11 with the scraper 12 attached is located in the slurry flowstream 14. As the scraper 12 moves over the face 11 of the magnetic housing 11 it disturbs and dislodges the ferromagnetic material 15 that has built-up, while still attracted to the magnet. The force of the moving flowstream 14, which is generally and most advantageously perpendicular to the wiper movement combined with the action of the wiping mechanism is sufficient to force the magnetic material 15 back into the flowstream and away from the magnetic source 10, thus cleaning the build-up of magnetic material 15 on the magnetic housing 11.

Flow rates will vary depending on the plant. Typical flow rates can be in the range from 20 m3/hr to 5000 m3/hr.

In Use

Figure 4:
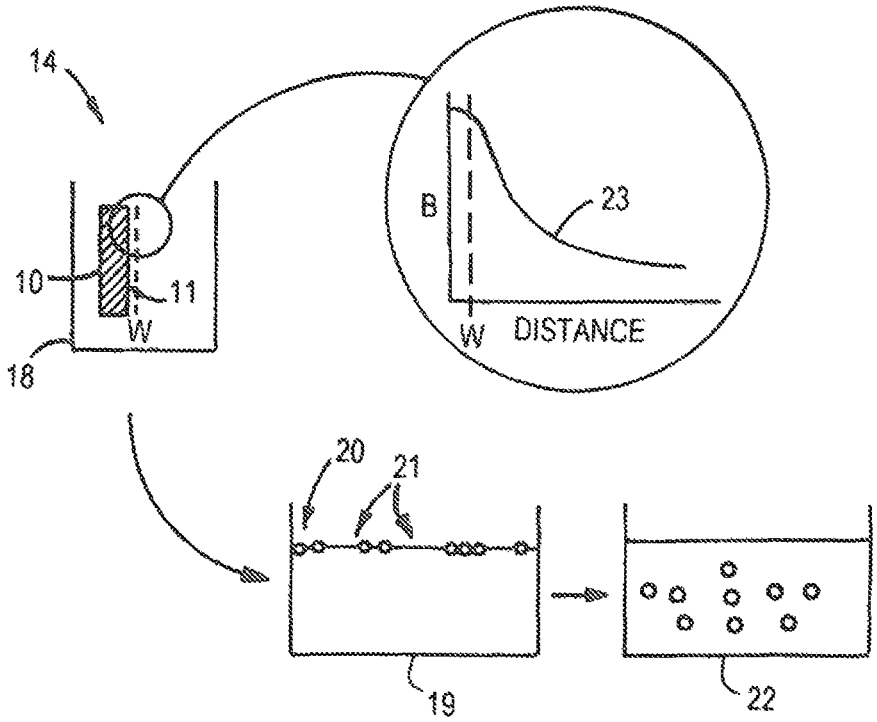
FIG. 4 is a diagram of application of embodiments of the present invention in a process environment.

With reference to FIG. 4, there is illustrated diagramatically a possible usage scenario for one or more embodiments previously described. In use in a typical ore processing plant a flowstream 14 containing particles of valuable ore passes into a processing chamber 18 having at least one magnetic source 10 located therein. The source 10 has a high strength magnetic field 23 which can fall away sharply with distance from the source as illustrated in the inset graph of FIG. 4. To this end a thin walled housing 11 having an external face 11 only a relatively short distance from the magnetic source 10 is utilised so as to maximise the high strength field to which the flowstream 14 is exposed as it passes through the chamber 18. The magnetic source 10 is fitted with a scraper 12 or similar arrangement as described with reference to the earlier embodiments thereby to periodically dislodge material which may have accumulated on face 11. The flowstream 14 and a substantial portion of the valuable ore particles entrained within it including any dislodged material 15 continues on to a further treatment tank 19 where valuable ore may be separated from the flowstream 14 by a flotation process wherein aggregated weakly magnetic particles 20 are actively floated in the froth 21. In accordance with the application of previously described embodiments, the amount of target particles is maximised and the amount of non-target particles entrained in the froth may be minimised. Those aggregated weakly magnetic particles not selected by the flotation process in tank 19 nor entrained in the froth can pass to a further treatment tank 22 where a further flotation process may be instigated and wherein a different target particle is selected for flotation.

The above describes only some embodiments of the present invention and modifications obvious to those skilled in the art can be made thereto without departing from the scope and spirit of the invention.

INDUSTRIAL APPLICABILITY

The above-described methods and apparatus have particular application in the field of mineral processing and, more particularly, for enhancing the efficiency of extraction of minerals, and in some instances multiple minerals in one or more stages, from a flowstream.

REFERENCES

Ahmed, N and Jameson, G, 1989. Flotation kinetics, *Mineral Processing and Extractive Metallurgy Review,* 50:77-99.

Bott, A and Lumsden, B, 2009. Magnetic conditioning at the Hellyer tailings retreatment plant, in *Proceedings of the Tenth Mill Operators Conference* 2009, pp 247-254, (The Australasian Institute of Mining and Metallurgy: Melbourne).

Dauchez, G., 1990 Magnetic separator operating in a wet environment, U.S. Pat. No. 53,137,629.

Duan, J. Fornasario, D. and Ralston, J., Calculations on the flotation rate constant of chalcopyrite particles in an ore. International Journal of Mineral Processing, 2003, 71, 227-237.

Engel, M., 1999, High intensity conditioning for flotation, PhD thesis (unpublished), University of Newcastle, Newcastle.

Engelhardt, D, Ellis, K and Lumsden, B, 2005. Improving fine sulfide mineral recovery—Plant evaluation of a new technology, in *Proceedings Centenary of Flotation Symposium*, pp 829-834 (The Australasian Institute of Mining and Metallurgy: Melbourne)

Finch, J and Dobby, G, 1990. *Column Flotation*, (Pergamom Press: Oxford).

Fuerstenau, D, Chander, S and Abouzeid, A, 1979. The recovery of fine particles by physical separation methods, *Beneficiation of Mineral Fines Problems and Research Needs* (ed P. Somasundaran and N. Arbiter) pp 3-61, (The American Institute of Mining, Metallurgical and Petroleum Engineers, Inc)

Holder, R, 1994. Improvement in copper and silver flotation at Hellyer using high energy conditioning., in *Proceedings of the Fifth Mill Operators' Conference*, pp 153-159 (The Australasian Institute of Mining and Metallurgy: Melbourne).

Holloway, B, Clarke, G and Lumsden, B, 2008, Improving fine lead and silver flotation recovery at BHP-Billiton's Cannington mine; in *Proceedings of the* 40$^{th}$ *Annual Meeting of the Canadian Mineral Processors* 2008, pp 347-362 (Canadian Institute of Mining, Metallurgy and Petroleum)

Jameson, G, Nguyen, A and Ata, S, 2007. The flotation of fine and coarse particles, *Froth Flotation a Century of Innovation*, (ed: M Fuerstenau, G Jameson and R Yoon), pp 339-372 (Society for Mining, Metallurgy and Exploration Inc.: Littleton).

Lu, S, Song, S and Dai, Z, 1988. The hydrophobic and magnetic combined aggregation of paramagnetic minerals, XVI International Mineral Processing Congress (ed: E Forssberg), pp 999-1009 (Elsevier: Amsterdam).

Lumsden, B and Miner, R, 2008. Apparatus and process for inducing magnetism, U.S. Pat. No. 7,429,331.

Nakamura, M., 1988: Magnetic filters, U.S. Pat. No. 4,722,788.

Rivett, T, Wood, G and Lumsden, B, 2007. Improving fine copper and gold flotation recovery—a plant evaluation, in *Proceedings of the Ninth Mill Operators' Conference*, pp 223-228 (The Australasian Institute of Mining and Metallurgy: Melbourne).

Peng, Y, Cotnoir, D, Ourriban, M, Richard, D and Liu, Q, 2005. Some solutions to the problems in fine particle flotation, in *Proceedings Centenary of Flotation Symposium*, pp 535-540 (The Australasian Institute of Mining and Metallurgy: Melbourne)

Sivamohan, R, 1990, The problem of recovering very fine particles in mineral processing—a review. *Int J Miner process* 28:247-288.

Singh, R, Rao, S, Maulik, S and Chakravorty, N, 1997. Fine particle flotation—recent trends, *Trans. Indian Inst Met,* 50(5):407-419.

Skvarla, J and Zelsnak, F, 2003. Magnetic-hydrophobic coagulation of paramagnetic minerals: a correlation of theory and experiments, *Int J Miner Process* 68:17-36

Somasundaran, P, 1980. Principles of flocculation, dispersion and selective flocculation, *International Fine Particle Processing Symposium*, (ed: P Somasunduran), pp 937-978 (SME)

Song, S, Lopez-Valdivieso, A, Reyes-Bahena, J, Bermjo-Perez, H and Trass O, 2000. Hydrophobic flocculation of galena fines in aqueous suspensions, *Journal of Colloid and Interface Science,* 227:272-281.

Song, S, Lopez-Valdivieso, A, Reyes-Bahena, J. and Bermjo-Perez, H, 2001. Hydrophobic flocculation of sphalerite fines in aqueous suspensions induced by alkyl xanthatea, Colloids and Surfaces A: Physicochemical Engineering Aspects, 181(1-30:159-169).

Song, S, Lopez-Valdivieso, A, Reyes-Bahena, J and Lara-Valenzuela, C, 2001. Floc-flotation of galena and sphalerite fines, *Min Eng,* 14(1):87-98.

Svoboda, J, 1981. A theoretical approach to the magnetic flocculation of weakly magnetic minerals, *Int J Miner Process* 8:377-390.

Svoboda, J, 1982. Magnetic flocculation and treatment of fine weakly magnetic minerals, *IEEE Trans Mag,* 18(2):796-801.

Svoboda, J. 1987. Magnetic Methods for the Treatment of Minerals, (Elsevier: Amsterdam).

Torrisi, C and Smith, R, 2003. Bringing split float to reality—the Cannington experience, in *Proceedings Eighth Mill Operators' Conference*, pp 73-80 (The Australasian Institute of Mining and Metallurgy: Melbourne).

Trahar, W and Warren, L, 1976. The floatability of very fine particles—a review, Int J Miner Process, 3:103-131.

Vaughan, D. J.; Craig, J. R. "Mineral chemistry of metal sulfides" Cambridge University Press, Cambridge: 1978

Trahar, W, 1981. A rational interpretation of the role of particle size in flotation, Int J Min Proc, 8:289-327.

The invention claimed is:

1. A preconditioning apparatus for inducing magnetism in a flowstream, the flowstream feeding continuously into a subsequent and separate separation process located downstream of the preconditioning apparatus, the flowstream including an at least partially magnetisable particulate feed material suspended in a liquid, the preconditioning apparatus comprising:

(i) a treatment chamber comprising an inlet and an outlet through which the entire flowstream respectively enters and exits the treatment chamber;

(ii) a magnetic source within the treatment chamber, wherein the magnetic source is substantially continuously immersed in the flowstream within the treatment chamber; and (iii) at least one wiper located inside the treatment chamber, wherein the at least one wiper moves over a face of the magnetic source, wherein the magnetic source is continuously activated with respect to the flowstream to condition the flowstream to enhance the subsequent and separate separation process, such that, at least a portion of the at least partially magnetisable particulate feed material is attracted to the magnetic source and adheres to the magnetic source as an accumulated magnetized material, and wherein movement of the at least one wiper over the face of the magnetic source in combination with a moving action of the flowstream removes accumulated magnetized material from the magnetic source to wash the accumulated magnetized material removed from the magnetic source back into the flowstream and through the treatment chamber without the magnetic source exiting the flowstream or being deactivated during removal of the magnetized material, thereby continuously magnetizing the flowstream.

2. The preconditioning apparatus of claim 1, wherein the accumulated magnetized material removed from the magnetic source remains in the flowstream and is not removed from the flowstream.

3. The preconditioning apparatus of claim 1, wherein the at least one wiper is made of a material selected from the group consisting of metal, plastic, rubber, and stainless steel.

4. The preconditioning apparatus of claim 1, further comprising at least one pneumatic piston, and wherein the at least one wiper is moved by the at least one pneumatic piston.

5. The preconditioning apparatus of claim 1, further comprising at least one electric motor, and wherein the at least one wiper is moved by the at least one electric motor.

6. The preconditioning apparatus of claim 1, wherein the at least one wiper moves in a longitudinal direction along the face of the magnetic source.

7. The preconditioning apparatus of claim 1, wherein the at least one wiper moves in a latitudinal direction along the face of the magnetic source.

8. The preconditioning apparatus of claim 1, wherein the at least one wiper disturbs the accumulated magnetized material so that the flow of the flowstream washes the accumulated magnetized material into the flowstream.

9. The preconditioning apparatus of claim 1, wherein the at least one wiper comprises a series of wipers.

10. The preconditioning apparatus of claim 1, wherein the magnetic source has a magnetic induction at an interface of the flowstream and the magnetic source of greater than 3000 gauss.

11. The preconditioning apparatus of claim 10, wherein the magnetic induction is substantially over the entirety of the magnetic source.

12. The preconditioning apparatus of claim 1, wherein the at least partially magnetisable particulate feed material includes paramagnetic, ferromagnetic and diamagnetic particulates.

13. The preconditioning apparatus of 12, wherein the paramagnetic particulates include at least one sulfide mineral.

14. The preconditioning apparatus of claim 12, wherein the paramagnetic particulates include at least one material selected from the group consisting of: sphalerite contaminated with iron, arsenopyrite, cassiterite, chalcopyrite, bornite, galena, pentiandite, platinum, gold, silver, and palladium.

15. The preconditioning apparatus of claim 13, wherein the at least one sulfide mineral contains lead.

16. The preconditioning apparatus of claim 13, wherein the at least one sulfide mineral contains a transition metal.

17. The preconditioning apparatus of claim 16, wherein the transition metal is selected from the group consisting of: copper, zinc, nickel, gold, silver, ruthenium, rhodium, palladium, osmium, iridium, and platinum.

18. The preconditioning apparatus of claim 1, wherein the at least one wiper is attached to the magnetic source.

19. The preconditioning apparatus of claim 1, wherein the at least one wiper is attached to the face of the magnetic source.

* * * * *